US008207496B2

(12) United States Patent
Makarov et al.

(10) Patent No.: US 8,207,496 B2
(45) Date of Patent: Jun. 26, 2012

(54) MULTI-NEEDLE MULTI-PARALLEL NANOSPRAY IONIZATION SOURCE FOR MASS SPECTROMETRY

(75) Inventors: Alexander A. Makarov, Bremen (DE); Eloy R. Wouters, San Jose, CA (US)

(73) Assignee: Thermo Finnigan LLC, San Jose, CA (US)

( * ) Notice: Subject to any disclaimer, the term of this patent is extended or adjusted under 35 U.S.C. 154(b) by 358 days.

(21) Appl. No.: 12/701,011

(22) Filed: Feb. 5, 2010

(65) Prior Publication Data

US 2011/0192968 A1 Aug. 11, 2011

(51) Int. Cl.

| | |
|---|---|
| ***H01J 49/26*** | (2006.01) |
| ***H01J 49/10*** | (2006.01) |
| ***H01J 49/04*** | (2006.01) |
| ***H01B 13/00*** | (2006.01) |

(52) U.S. Cl. ..... 250/288; 250/282; 250/423 R; 250/425; 29/290.143; 216/18; 216/39; 210/748.01

(58) Field of Classification Search ..... 250/281–283, 250/288, 423 R, 424, 425; 210/198.2, 199, 210/200, 243, 748.01, 656; 29/890.142, 29/890.143; 216/17, 18, 39

See application file for complete search history.

(56) References Cited

U.S. PATENT DOCUMENTS

| | | | | |
|---|---|---|---|---|
| 5,173,610 | A * | 12/1992 | Lo | 250/424 |
| 5,397,901 | A * | 3/1995 | Lo | 250/424 |
| 6,245,227 | B1 | 6/2001 | Moon et al. | |
| 6,563,111 | B1 | 5/2003 | Moon et al. | |
| 6,633,031 | B1 | 10/2003 | Schultz et al. | |
| 6,744,046 | B2 * | 6/2004 | Valaskovic et al. | 250/288 |
| 8,080,930 | B2 * | 12/2011 | King | 313/359.1 |
| 2002/0000517 | A1 | 1/2002 | Corso et al. | |
| 2002/0158027 | A1 | 10/2002 | Moon et al. | |
| 2002/0175281 | A1 | 11/2002 | Valaskovic | |
| 2002/0185595 | A1 | 12/2002 | Smith et al. | |
| 2003/0111599 | A1 | 6/2003 | Staats | |
| 2003/0143493 | A1 | 7/2003 | Schultz et al. | |
| 2003/0160166 | A1 | 8/2003 | Glish et al. | |

(Continued)

FOREIGN PATENT DOCUMENTS

WO WO 2009/114951 A1 9/2009

OTHER PUBLICATIONS

Wouters et al., "Apparatus and Methods for Pneumatically-Assisted Electrospray Emitter Array," U.S. Appl. No. 12/642,573, filed Dec. 18, 2009, pp. 1-41.

(Continued)

*Primary Examiner* — Bernard E Souw
(74) *Attorney, Agent, or Firm* — Thomas F. Cooney

(57) ABSTRACT

An electrospray ion source for a mass spectrometer includes an electrode comprising at least a first plurality of protrusions protruding from a base, each protrusion of the at least a first plurality of protrusions having a respective tip; a conduit for delivering an analyte-bearing liquid to the electrode; and a voltage source, wherein, in operation of the electrospray ion source, the analyte-bearing liquid is caused to move, in the presence of a gas or air, from the base to each protrusion tip along a respective protrusion exterior so as to form a respective stream of charged particles emitted towards an ion inlet aperture of the mass spectrometer under application of voltage applied to the electrode from the voltage source.

35 Claims, 13 Drawing Sheets

U.S. PATENT DOCUMENTS

| | | | | |
|---|---|---|---|---|
| 2003/0168591 | A1 | 9/2003 | Smith et al. | |
| 2003/0201390 | A1 | 10/2003 | Corso et al. | |
| 2003/0213918 | A1 | 11/2003 | Kameoka et al. | |
| 2004/0173743 | A1* | 9/2004 | Valaskovic et al. | 250/288 |
| 2004/0227072 | A1 | 11/2004 | Park | |
| 2005/0054208 | A1 | 3/2005 | Fedorov et al. | |
| 2005/0252840 | A1* | 11/2005 | Arnold et al. | 210/198.2 |
| 2006/0103051 | A1 | 5/2006 | Staats | |
| 2006/0113463 | A1 | 6/2006 | Rossier et al. | |
| 2006/0186329 | A1 | 8/2006 | Gebhardt et al. | |
| 2006/0192107 | A1 | 8/2006 | DeVoe et al. | |
| 2006/0207877 | A1 | 9/2006 | Schmidt et al. | |
| 2006/0208186 | A1 | 9/2006 | Goodley et al. | |
| 2007/0183928 | A1* | 8/2007 | Neyer et al. | 422/70 |
| 2009/0056133 | A1 | 3/2009 | Waits et al. | |
| 2009/0095057 | A1 | 4/2009 | Staats | |
| 2009/0114814 | A1 | 5/2009 | Nissila et al. | |
| 2009/0140137 | A1 | 6/2009 | Hiraoka et al. | |
| 2009/0230296 | A1 | 9/2009 | Kelly et al. | |
| 2009/0294363 | A1* | 12/2009 | Liu | 210/656 |
| 2011/0192217 | A1* | 8/2011 | Choikhet et al. | 73/61.55 |
| 2012/0043460 | A1* | 2/2012 | Wouters et al. | 250/282 |

OTHER PUBLICATIONS

Blaise Laurent Patrick Gassend, "A Fully Microfabricated Two-Dimensional Electrospray Array with Applications to Space Propulsion," PhD Dissertation, MIT 2007, pp. 1-104.

Chen et al., "Characteristics of Probe Electrospray Generated from a Solid Needle," J. Phys. Chem. B 2008, 112, pp. 11164-11170.

Chen et al., "Abstract," J. Phys. Chem. B, 2008, 112 (35), pp. 11164-11170.

Ficarro et al., "Improved Electrospray Ionization Efficiency Compensates for Diminished Chromatographic Resolution and Enables Proteomics Analysis of Tyrosine Signaling in Embryonic Stem Cells," Anal. Chem. 2009, 81, pp. 3440-3447.

Peter Forbes, "Self-Cleaning Materials—The lotus plant's magnificent ability to repel dirt has inspired a range of self-cleaning and antibacterial technologies that may also help control microfluidic "lab-on-a-chip" devices.," Scientific American (2008), pp. 88-95.

Gassend et al., "A Microfabricated Planar Electrospray Array Ionic Liquid Ion Source With Integrated Extractor," Journal of Microelectromechanical Systems, vol. 18, No. 3 (2009), pp. 679-694.

Gassend et al., "A Fully-Integrated Microfabricated Externally-Wetted Electrospray Thruster," 30th International Electric Propulsion Conference, Florence, Italy, Sep. 17-20, 2007, pp. 1-11.

Ibrahim et al., "Improving Mass Spectrometer Sensitivity Using a High-Pressure Electrodynamic Ion Funnel Interface," J. Am. Soc. Mass Spectrom. 2006, 17, pp. 1299-1305.

Kelly et al., "Array of Chemically Etched Fused-Silica Emitters for Improving the Sensitivity and Quantitation of Electrospray Ionization Mass Spectrometry," Anal. Chem. 2007, 79, pp. 4192-4198.

Kelly et al., "Elastomeric Microchip Electrospray Emitter for Stable Cone-Jet Mode Operation in the Nanoflow Regime," Anal. Chem. 2008, 80, pp. 3824-3831.

Kelly et al., "Nanoelectrospray Emitter Arrays Providing Interemitter Electric Field Uniformity," Anal. Chem. 2008, 80, pp. 5660-5665.

Kingham et al., "Shape of a Liquid Metal Ion Source," Appl. Phys. A 34 (1984), pp. 123-132.

Krpoun et al., "Integrated out-of-plane Nanoelectrospray Thruster Arrays for Spacecraft Propulsion," J. Micromech. Microeng. 19 (2009) 045019, pp. 1-10.

Manohara et al., "Arrays of Bundles of Carbon Nanotubes as Field Emitters," http://www.techbriefs.com/component/content/article/1206, pp. 1-3.

Oleinikov et al., "The Study of the Desorption/Ionization from the Replicas of Etched Ion Tracks," Radiation Measurements 43 (2008), pp. S635-S638.

Patel et al., "Complex Multifunctional Polymer / Carbon-Nanotube Composites," NASA Tech Briefs (2009), http://www.techbriefs.com/component/content/article/3540.

Schultz et al., "A Fully Integrated Monolithic Microchip Electrospray Device for Mass Spectrometry," Anal. Chem. 2000, 72, pp. 4058-4063.

Sen et al., "Simulation and Parametric Study of a Novel Multi-Spray Emitter for ESI-MS Applications," Microfluid Nanofluid (2007) 3:283-298.

Shikida et al., "Non-Photolithographic Pattern Transfer for Fabricating Arrayed Three-Dimensional Microstructures by Chemical Anisotropic Etching," Sensors and Actuators A 116 (2004), pp. 264-271.

Shikida et al., "Non-Photolithographic Pattern Transfer for Fabricating Pen-Shaped Microneedle Structures," J. Micromech. Microeng. 14 (2004), pp. 1462-1467.

Shikida et al., "Fabrication of Densely Arrayed Micro-Needles with Flow Channels by Mechanical Dicing and Anisotropic Wet Etching," J. Micromech. Microeng. 16 (2006), pp. 1740-1747.

Shikida et al., "Fabrication of a Hollow Needle Structure by Dicing, Wet Etching and Metal Deposition," J. Micromech. Microeng. 16 (2006), pp. 2230-2239.

Tang et al., "Generation of Multiple Electrosprays Using Microfabricated Emitter Arrays for Improved Mass Spectrometric Sensitivity," Anal. Chem. 2001, 73, pp. 1658-1663.

Toda et al., "Fabrication of Gate-Electrode Integrated Carbon-Nanotube Bundle Field Emitters," NASA's Jet Propulsion Laboratory (2008), http://www.greentechbriefs.org/component/content/2710?task=view.

Toda et al., "Improved Photoresist Coating for Making CNT Field Emitters," NASA Tech Briefs (2009), pp. 38, 40.

Toda et al., "Improved Photoresist Coating for Making CNT Field Emitters," NASA's Jet Propulsion Laboratory (2009), http://www.techbriefs.com/component/content/article/3532.

Velasquez-Garcia et al., "A Micro-Fabricated Linear Array of Electrospray Emitters for Thruster Applications," Journal of Microelectromechanical Systems, vol. 15, No. 5 (2006), pp. 1260-1271.

Velasquez-Garcia et al., "A Planar Array of Micro-Fabricated Electrospray Emitters for Thruster Applications," Journal of Microelectromechanical Systems, vol. 15, No. 5 (2006), pp. 1272-1280.

Wilm et al., "Analytical Properties of the Nanoelectrospray Ion Source," Anal. Chem. 1996, 68, pp. 1-8.

* cited by examiner

MULTI-NEEDLE MULTI-PARALLEL NANOSPRAY IONIZATION SOURCE FOR MASS SPECTROMETRY

FIELD OF THE INVENTION

The present invention relates to ionization sources for mass spectrometry and, in particular, to a nano-electrospray ionization source comprising a surface having a plurality of protruding microscopic to sub-microscopic pillars, cones, needles, or wires each of which acts to emit ions from an analyte-bearing liquid applied to its exterior surface.

BACKGROUND OF THE INVENTION

The well-known technique of electrospray ionization is used in mass spectrometry to produce ions. In conventional electrospray ionization, a liquid is pushed through a very small charged capillary. This liquid contains the analyte to be studied dissolved in a large amount of solvent, which is usually more volatile than the analyte. The conventional electrospray process involves breaking the meniscus of a charged liquid formed at the end of the capillary tube into fine droplets using an electric field. The electric field induced between the electrode and the conducting liquid initially causes a Taylor cone to form at the tip of the tube where the field becomes concentrated. Fluctuations cause the cone tip to break up into fine droplets which are sprayed, under the influence of the electric field, into a chamber at atmospheric pressure, optionally in the presence of drying gases. The optionally heated drying gas causes the solvent in the droplets to evaporate. According to a generally accepted theory, as the droplets shrink, the charge concentration in the droplets increases. Eventually, the repulsive force between ions with like charges exceeds the cohesive forces and the ions are ejected (desorbed) into the gas phase. The ions are attracted to and pass through a capillary or sampling orifice into the mass analyzer.

Incomplete droplet evaporation and ion desolvation can cause high levels of background counts in mass spectra, thus causing interference in the detection and quantification of analytes present in low concentration. It has been observed that smaller initial electrospray droplets tend to be more readily evaporated and, further, that droplet sizes decrease with decreasing flow rate. Thus, it is desirable to reduce the flow rate and, consequently, the droplet size, as much as possible in order to obtain mass spectra with minimal background interference. Nano-electrospray, with flow rates per emitter in the range of less than several hundred nanoliters per minute to 1 nanoliter per minute, has been found to yield very good results, in this regard. Further, it has been found that the efficiency of ionization is much higher in nanospray mode and that the response is more linear than in other spray modes. For instance, Ficcaro et al., in a technical paper titled "Improved Electrospray Ionization Efficiency Compensates for Diminished Chromatic Resolution and Enables Proteomics Analysis of Tyrosine Signaling in Embryonic Stem Cells" (Analytical Chemistry 81, 2009, pp. 3440-3447), demonstrate that, in the assessment of LCMS performance, the improved electrospray ionization efficiency at low flow rates outweighs deterioration of chromatographic separation, even at chromatographic flow rates below Van Deemter minima. However, conventional electrospray devices and conventional liquid chromatography apparatuses which deliver eluent to such electrospray devices are typically associated with flow rates of several microliters per minute up to 1 ml per minute.

Attempts have been made to manufacture an electrospray device which produces nanoelectrospray. For example, Wilm and Mann, Anal. Chem. 1996, 68, 1-8 describes the process of electrospray from fused silica capillaries drawn to an inner diameter of 2-4 μm at flow rates of 20 nl/min. Specifically, a nanoelectrospray at 20 nl/min was achieved from a 2 μm inner diameter and 5 μm outer diameter pulled fused-silica capillary with 600-700 V at a distance of 1-2 mm from the ion-sampling orifice of an Atmospheric Pressure Ionization mass spectrometer. Other nano-electrospray devices have been fabricated from substantially planar substrates with microfabrication techniques that have been borrowed from the electronics industry and microelectromechanical systems (MEMS), such as chemical vapor deposition, molecular beam epitaxy, photolithography, chemical etching, dry etching (reactive ion etching and deep reactive ion etching), molding, laser ablation, etc.

In order to realize the aforementioned benefits of nano-electrospray at higher overall flow rates, electrospray arrays of densely packed tubes or nozzles have been developed, using either capillary pulling or microfabrication and MEMS techniques, so as to increase the overall flow rate without affecting the size of the ejected droplets. For example, FIG. 1 illustrates an array of fused-silica capillary nano-electrospray ionization emitters arranged in a circular geometry, as taught in United States Patent Application Publication 2009/0230296 A1, in the names of Kelly et al. Each nano-electrospray ionization emitter 2 comprises a fused silica capillary having a tapered tip 3. As taught in United States Patent Application Publication 2009/0230296 A1, the tapered tips can be formed either by traditional pulling techniques or by chemical etching and the radial arrays can be fabricated by passing approximately 6 cm lengths of fused silica capillaries through holes in one or more discs 1. The holes in the disc or discs may be placed at the desired radial distance and inter-emitter spacing and two such discs can be separated to cause the capillaries to run parallel to one another at the tips of the nano-electrospray ionization emitters and the portions leading thereto.

FIGS. 2A-2B show, respectively, a schematic view of one electrospray system and a cross-sectional view of an electrospray device of the system, as taught in United States Patent Application Publication 2002/0158027 A1, in the name of Moon et al. The electrospray device 4 generally comprises a silicon substrate or microchip or wafer 5 defining a channel 6 through substrate 5 between an entrance orifice 7 on an injection surface 8 and a nozzle 9 on an ejection surface 10. The nozzle 9 has an inner and an outer diameter and is defined by a recessed region 11. The region 11 is recessed from the ejection surface 10, extends outwardly from the nozzle 9 and may be annular. The tip of the nozzle 9 does not extend beyond the ejection surface 10 to thereby protect the nozzle 9 from accidental breakage.

A grid-plane region 12 of the ejection surface 10 is exterior to the nozzle 9 and to the recessed region 11 and may provide a surface on which a layer of conductive material 14 including a conductive electrode 15 may be formed for the application of an electric potential to the substrate 5 to modify the electric field pattern between the ejection surface 10, including the nozzle tip 9, and the extracting electrode 54. Alternatively, the conductive electrode may be provided on the injection surface 8 (not shown).

The electrospray device 4 further comprises a layer of silicon dioxide 13 over the surfaces of the substrate 5 through which the electrode 15 is in contact with the substrate 5 either on the ejection surface 10 or on the injection surface 8. The silicon dioxide 13 formed on the walls of the channel 6 electrically isolates a fluid therein from the silicon substrate 5 and thus allows for the independent application and sustenance of different electrical potentials to the fluid in the channel 6 and to the silicon substrate 5. Alternatively, the substrate 5 can be controlled to the same electrical potential as the fluid.

As shown in FIG. 2A, to generate an electrospray, fluid may be delivered to the entrance orifice 7 of the electrospray device 4 by, for example, a capillary 16 or micropipette. The fluid is subjected to a potential voltage $V_{fluid}$ via a wire (not shown) positioned in the capillary 16 or in the channel 6 or via an electrode (not shown) provided on the injection surface 8 and isolated from the surrounding surface region and the substrate 5. A potential voltage $V_{substrate}$ may also be applied to the electrode 4 on the grid-plane 12, the magnitude of which is preferably adjustable for optimization of the electrospray characteristics. The fluid flows through the channel 6 and exits or is ejected from the nozzle 9 in the form of very fine, highly charged fluidic droplets 18. The extracting electrode 17 may be held at a potential voltage $V_{extract}$ such that the electrospray is drawn toward the extracting electrode 17 under the influence of an electric field.

All presently known nano-electrospray array devices utilize a conventional delivery method in which analyte-bearing liquid is delivered to a hollow nozzle by means of micro-capillaries or micro-tubes, so as to be emitted from an interior bore of the nozzle. There are many limitations to the use of such small-bore capillaries and nozzles, such as clogging, difficulty in producing a spray and, in the case of silica capillaries, difficult handling. Furthermore, with such conventional electrospray delivery techniques, an increase in salt concentration results in spraying difficulty and there is a sudden decline in desorption efficiency of ions into the gaseous phase. Accordingly, such delivery methods cannot be applied to NaCl aqueous solutions on the order of 150 mM, such as physiological saline solution.

SUMMARY OF THE INVENTION

In order to address the above identified limitations in the art, there are provided various methods and apparatuses for a multi-needle parallel nanospray ionization source for mass spectrometry.

In a first aspect of the invention, there is disclosed an electrospray ion source for a mass spectrometer comprising: an electrode comprising at least a first plurality of protrusions protruding from a base, each protrusion of the at least a first plurality of protrusions having a respective tip; a conduit for delivering an analyte-bearing liquid to the electrode; and a voltage source, wherein, in operation of the electrospray ion source, the analyte-bearing liquid is caused to move, in the presence of a gas or air, from the base to each protrusion tip along a respective protrusion exterior so as to form a respective stream of charged particles emitted towards an ion inlet aperture of the mass spectrometer under application of voltage applied to the electrode from the voltage source. The first plurality of protrusions may occupy an area of the electrode having a shape that corresponds to a shape of the ion inlet aperture. Various embodiments may comprise a coating layer adhered to at least a portion of each of the protrusions, the coating layer providing an increase in a tendency of the analyte-bearing liquid to be drawn towards the protrusion tips. Various embodiments may comprise an extractor electrode spaced at a distance from the electrode so as to form a gap therebetween, the extractor electrode having an aperture therein such that, in operation of the electrospray ion source, an electric field between the electrode and the extractor electrode causes a portion of the emitted charged particles to be propelled through the aperture in the extractor electrode. Various embodiments may comprise a bottom substrate adhered to a side of the electrode opposite to the protrusions so as to provide structural support to the electrode. Various embodiments may comprise a cover plate having at least one aperture therein; and a spacer disposed between the cover plate and the base of the electrode, so as to form a gap between at least a portion of the cover plate and at least a portion of the electrode, such that analyte-bearing liquid delivered from the conduit is caused to flow into the gap, wherein the first plurality of protrusions protrude through the at least one aperture.

In other aspects of the invention, there are disclosed methods of fabricating a multi-emitter electrospray electrode including the steps of: providing a substrate; exposing a first side of the substrate to a beam of accelerated heavy ions so as to produce a set of latent ion tracks within the substrate that do not penetrate to an opposite side of the substrate; exposing the first side of the substrate to a chemical etchant so as to form a plurality of etch channels within the substrate that extend into the substrate interior from the first side and that do not penetrate to the opposite side of the substrate; and depositing a layer of conductive material within the etch channels and on the first side of the substrate. Alternative subsequent steps may include either removing the substrate from the conductive material, the conductive material comprising the multi-emitter electrospray electrode or removing a portion of the opposite side of the substrate and at least a portion of the tips of the conical pillars so as to truncate a subset of the plurality of conical pillars, the truncated conical pillars comprising hollow electrospray nozzles of the multi-emitter electrospray electrode.

In yet other aspects of the invention, there are disclosed methods for providing ions derived from an analyte-bearing liquid to a mass spectrometer by electrospray ionization, the analyte-bearing liquid supplied at a total flow rate of greater than or equal to 50 microliters (μl) per minute comprising: (a) dividing the total flow into a plurality of sub-flows of analyte-bearing liquid, each sub flow providing a portion of the total flow at a rate of less than or equal to 500 nanoliters (nl) per minute; (b) providing a plurality of electrospray emitters; (c) providing each sub-flow of analyte bearing liquid to a respective one of the electrospray emitters; (d) generating an electrospray emission from each of the electrospray emitters in the presence of a gas or air; and (e) directing each electrospray emission to an ion inlet of the mass spectrometer. The gas or air, which may be at atmospheric pressure in various embodiments, may provide controllable evaporation of a solvent or aid in de-clustering between analyte ions and other particles. In other embodiments, the gas or air may be maintained at a pressure within a range of 0.03×atmospheric pressure to 2×atmospheric pressure.

Apparatus in accordance with the present teachings can comprise a material that has a large number of pillars per unit area—typically 1000-500,000 per square centimeter, corresponding to an average inter-pillar spacing in the range of approximately 6-320 μm. The tips of the pillars, from which ions are emitted when the electrode is in use as an electrospray emitter, can have a diameter of less than 1 μm. The density of pillars may controlled by controlling the duration of exposure of the substrate to the accelerated heavy ions.

Although the protrusions in this example are described as "pillars", it should be clear that, depending on form factors, semantic preferences and other circumstances, the protrusions of the electrodes described in this document may, in any particular instance, be more aptly described as "columns", "cones", "needles", "rods" or "wires". These are all various types of protrusions or protruding surfaces away from a base or away from a basal surface. The ion emitters described herein may variously be described as "protrusions", "pillars", "columns", "cones", "needles", "rods", "wires" or even "capillaries" depending on form factors, shape, materials employed, method of manufacture, or other circumstances or factors. The present teachings provide benefits, relative to the conventional art, of providing simple manufacturability and robust multisprayer devices. Instead of a single nanospray tip, as in the conventional art, the present teachings provide thousands (or more) of nanospray emitters operating in parallel. Thus, the benefits of nanospray—namely, high ionization efficiency due to the small initial droplet size—can be married to the larger flow rates, 1 μl/min-10 ml/min, of standard liquid chromatography assays. A further advantage is that the disabling or malfunctioning of a single—or even several—of the emitters has a negligible effect on the overall mass spectrometry results. Also, for those embodiments in which the sample flows on the outside of the needles, the clogging issues that occur with nanospray capillaries are eliminated.

To efficiently capture all the ions generated when using apparatus or methods in accordance with the present teachings, the atmospheric pressure ion inlet to a mass spectrometer can be modified from the traditional circular cross section to a more elongated or letter box shape, or can take the shape of an array of ion transfer tubes. The array can be linear or circular to most efficiently match the dimensions of the droplet mist. Such ion inlet modifications, when used in conjunction with ion sources disclosed herein, are expected to provide increased sensitivity relative to existing ion source/mass spectrometer assemblies.

DETAILED DESCRIPTION

The present invention provides methods and apparatus for an improved ionization source for mass spectrometry. The following description is presented to enable one of ordinary skill in the art to make and use the invention and is provided in the context of a particular application and its requirements. It will be clear from this description that the invention is not limited to the illustrated examples but that the invention also includes a variety of modifications and embodiments thereto. Therefore the present description should be seen as illustrative and not limiting. While the invention is susceptible of various modifications and alternative constructions, it should be understood that there is no intention to limit the invention to the specific forms disclosed. On the contrary, the invention is to cover all modifications, alternative constructions, and equivalents falling within the essence and scope of the invention as defined in the claims. To more particularly describe the features of the present invention, please refer to the attached in conjunction with the discussion below.

Figure 1:
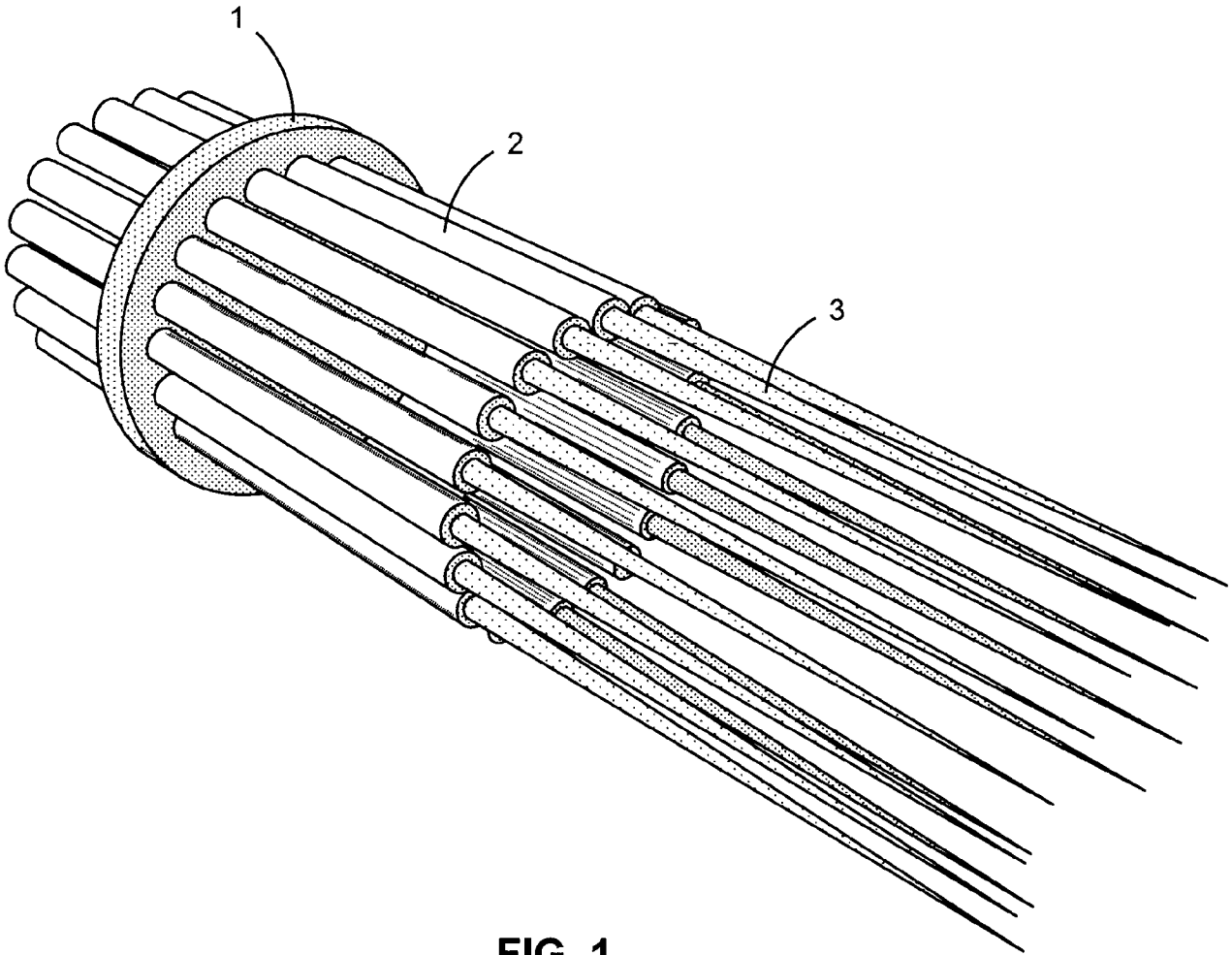
FIG. 1 (Prior Art)
FIG. 1 illustrates an example of a known array of fused-silica capillary nano-electrospray ionization emitters arranged in a circular geometry.
Figure 2A:
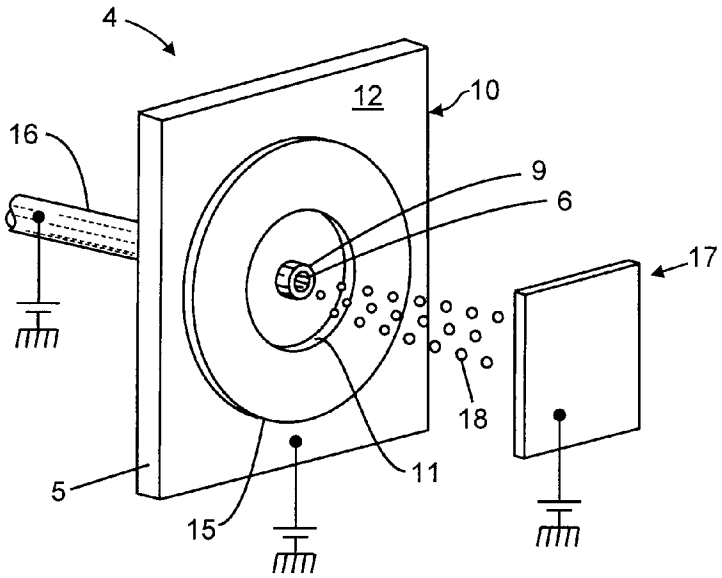
FIG. 2A (Prior Art)
FIGS. 2A-2B show, respectively, a schematic view of a conventional electrospray system and a cross-sectional view of an electrospray device of the system.
Figure 2B:
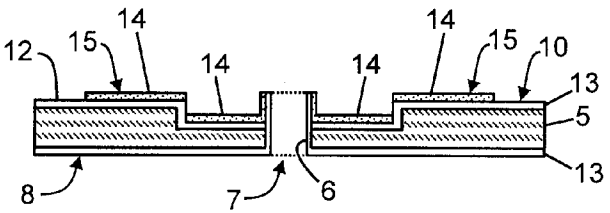
FIG. 2B (Prior Art)
Figure 3:
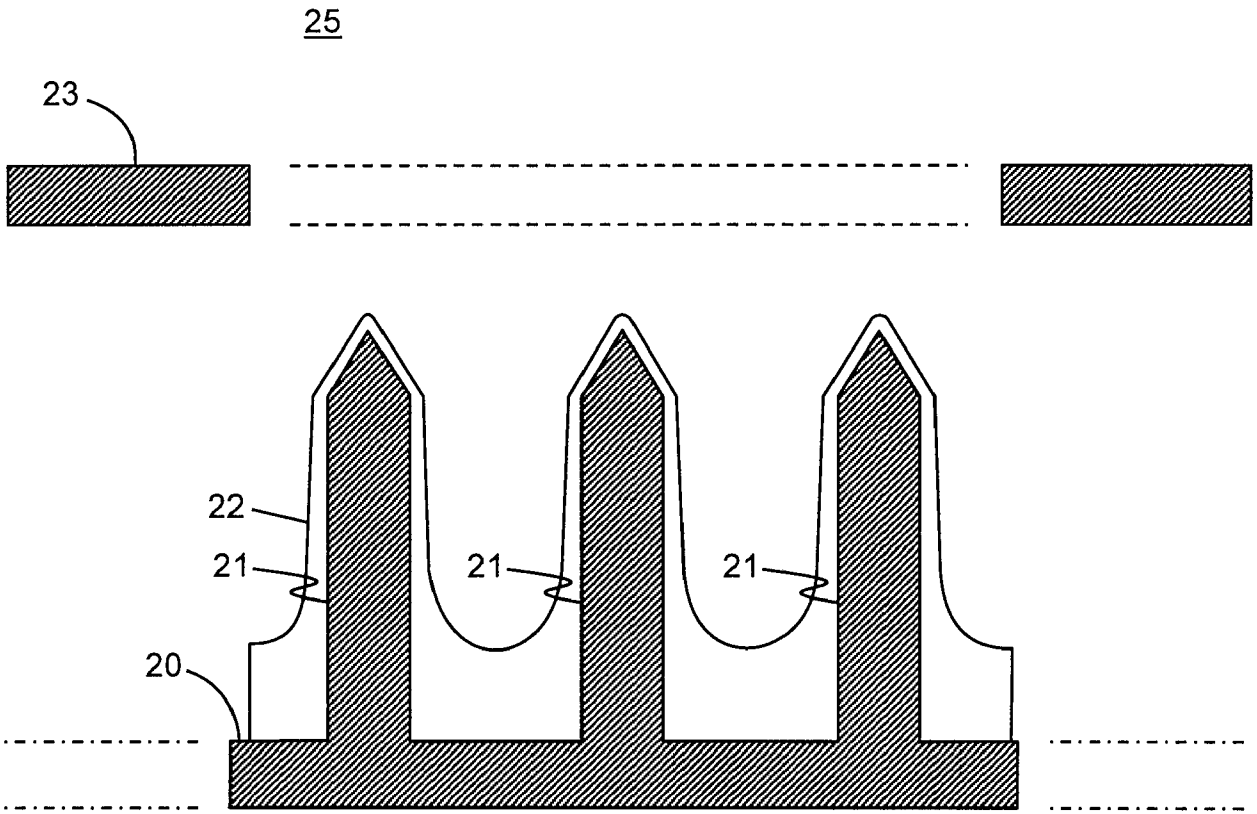
FIG. 3 (Prior Art)
FIG. 3 schematically illustrates a known electrospray emitter array apparatus intended for spacecraft thruster applications.

Most electrospray ionization devices used in mass spectrometry utilize hollow emitter structures, comprising internal channels through which an analyte-bearing fluid flows until it emerges at a hollow emitter tip. However, electrospray emitters are known to which fluid is supplied externally. For instance, Velásquez-García et al., in a technical paper titled "A planar array of micro-fabricated electrospray emitters for thruster applications (Journal of Microelectromechanical Systems, 15(5), 2006, pp. 1272-1280) describe planar arrays of micro-fabricated electrospray emitters intended for space propulsion applications. As shown in FIG. 3, one such electrospray emitter array apparatus 25 includes a plurality of pencil-like micro-column emitters 21 formed on and integrated with a substrate 20, such as a doped silicon wafer, by standard micro-machining techniques. A propellant fluid 22, the controlled ionization of which provides thrust, is introduced onto the substrate. A combination of surface tension and electrostatic pulling effects cause the fluid 22 to adhere onto and around the exterior of the emitter columns 21. A voltage applied across the emitter columns 21 and an extractor electrode 23 causes the electrospray emission of charged particles produced by ionization of the propellant fluid 22. An accelerator electrode (not shown in FIG. 3) is also included as part of the thruster apparatus. As described by Velásquez-García et al., the propellant is the ionic liquid ethyl-methyl-imidazolium tetrafluoroborate (EMI-$BF_4$), the substrate and micro-columns are surface-treated silicon and the operating conditions are such that ions are extracted directly from the liquid, without formation of liquid droplets.

Figure 4:
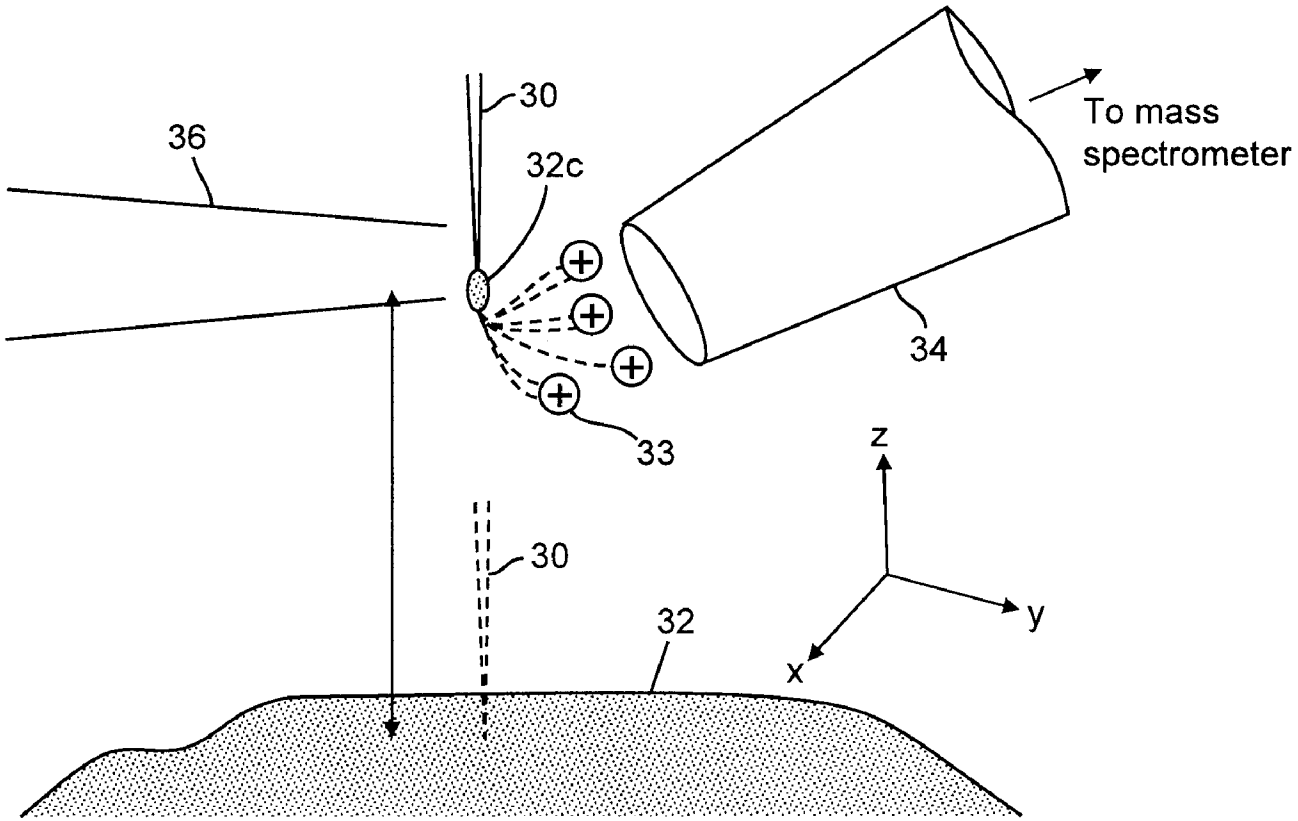
FIG. 4 (Prior Art)
FIG. 4 schematically illustrates a known electrospray emitter comprising a solid probe capable of reciprocating between a bottom end point at which a tip of the probe contacts a sample and a top end point spaced away from the sample at which a voltage is applied to the probe such that a portion of the sample adhering to the probe tip is ionized so as to emit ions to a mass spectrometer.

United States Patent Application Publication 2009/0140137 A1 in the names of Hiraoka et al. teaches an ionization apparatus comprising holding means for holding a probe so as to be capable of reciprocating between a bottom end point at which a tip of the probe contacts a sample and a top end point at which the tip of the probe is spaced away from the sample; an ion guide, arranged such that the tip of the ion guide is positioned in the vicinity of the tip of the probe in the vicinity of the top end point, for introducing sample ions from the tip thereof to a mass spectrometry apparatus; and a high voltage generating apparatus applying a high voltage for electrospray between the probe and the ion guide, at least at a time when the probe is separated from the sample. A portion of the Hiraoka et al. apparatus is illustrated in FIG. 4. The metal probe or needle 30 is oscillated, as schematically illustrated by the vertical double-headed arrow, between the origin position (top end point) and a position (bottom end point or sample capture position, shown as dashed lines) at which the tip of the probe contacts the sample 32 and a portion 32*c* of the sample is captured onto the probe tip. With the probe at the top end point, a voltage is applied to the probe so as to produce electrospray and thereby ionize the captured portion of the sample. Sample ions produced under atmospheric pressure are introduced to a mass spectrometer either through an ion-sampling capillary 34, an orifice, or directly.

As taught by Hiraoka et al., a laser device (not shown) for irradiating the vicinity of the probe tip with laser light (ultraviolet, infrared or visible light) may be provided, such that the vicinity of the probe tip at the origin position or a position somewhat removed from the tip (a spaced-away position beneath the tip) may be irradiated with the laser beam 36. In the case of visible laser light [e.g., a frequency-doubled (532 nm) YAG laser], a surface plasmon is induced on the metal (probe) surface irradiated with the laser beam. The surface plasmon propagates along the probe surface toward the tip and intensifies the electric field strength in the vicinity of the probe tip. Accordingly, desorption ionization of sample molecules by electrospray is intensified. In a case where use is made of infrared laser light, promotion of sample drying and efficiency of ion desorption from a droplet are improved by heating the captured sample portion 32*c*.

Figure 5:
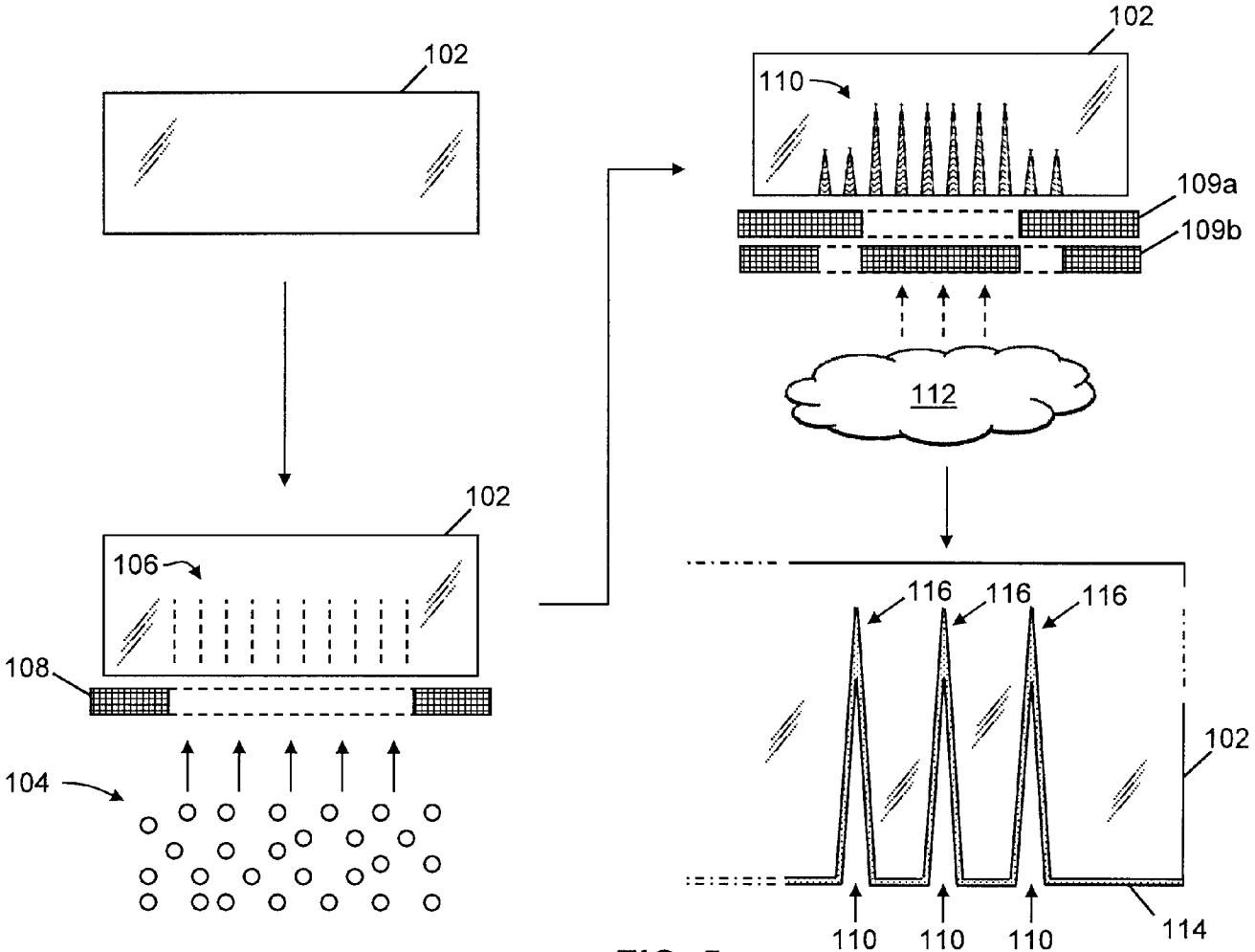
FIG. 5 schematically illustrates steps in the fabrication of a micro-pillar array electrospray device in accordance with the present invention.

FIG. 5 schematically illustrates initial steps in the fabrication of a micro-pillar array electrospray device in accordance with the present invention. First, a suitable substrate 102, such as a polycarbonate material, is provided. At least a portion of the substrate 102 is exposed to a beam of accelerated heavy ions 104 so as to produce a set of latent ion tracks 106 within the substrate. Each such latent ion track corresponds to a cylindrical zone of permanent modification or decomposition of the substrate material, such zone being preferentially susceptible to subsequent chemical etching. A mask 108 may be positioned between the heavy ion source and the substrate 102 so as to prevent some portions of the substrate from being exposed to the accelerated heavy ions. The use of the mask in this fashion can control the size or shape of the resulting region of latent ion tracks.

The latent ion tracks are exposed to a suitable etchant 112 so as to produce an array of etch channels 110 within the substrate 102. Although the etch channels are shown as conical in shape, the etch channels may be made to approach cylindrical shapes by appropriate choice of etchant selectivity (the ratio of the etch rate of the latent track zone to the etch rate of the bulk substrate). One or more patterned masks, such as masks 109*a* and 109*b*, may be employed, either sequentially or simultaneously, so as to produce differential etch depths. For instance, mask 109*a* may be initially employed so as to expose a central portion of the set of latent ion tracks to an etchant for a first length of time so as to produce relatively deep channels. Mask 109*b* may be subsequently employed to expose peripheral regions of the set of latent ion tracks to the etchant for a shorter length of time, so as to produce relatively shallow channels in a region surrounding the deeper channels.

After the etch channels are formed at the desired depths, a multi-pillared electrode 114 may be formed by deposition of a conductive material in the etch channels 110 and onto an adjoining face of the substrate, the etch channels and adjoining face acting as a mold for the formation of the multi-pillared electrode 114. For instance, metal may be first sputtered onto the etched substrate so as to produce a continuous thin coating of metal within the etch channels and on the face of the substrate. Subsequently, the thin metal coating may used as an electrode in an electroplating process to as deposit a larger amount of bulk metal within the same regions, thereby forming the multi-pillared electrode 114 comprising a plurality of pillars 116.

The process described above can produce a material that has a large number of pillars per unit area—typically 10-100 million per square centimeter, corresponding to an average inter-pillar spacing in the range of 1-3 μm. The tips of the pillars, from which ions are emitted when the electrode is in use as an electrospray emitter, can have a diameter of less than 1 μm. The density of pillars may controlled by controlling the duration of exposure of the substrate to the accelerated heavy ions. Although the protrusions in this example are described as "pillars", it should be clear that, depending on form factors, semantic preferences and other circumstances, the protrusions of the electrodes described in this document may, in any particular instance, be more aptly described as "columns", "cones", "needles", "rods" or "wires". These are all various types of protrusions or protruding surfaces away from a base or away from a basal surface.

Figure 6A:
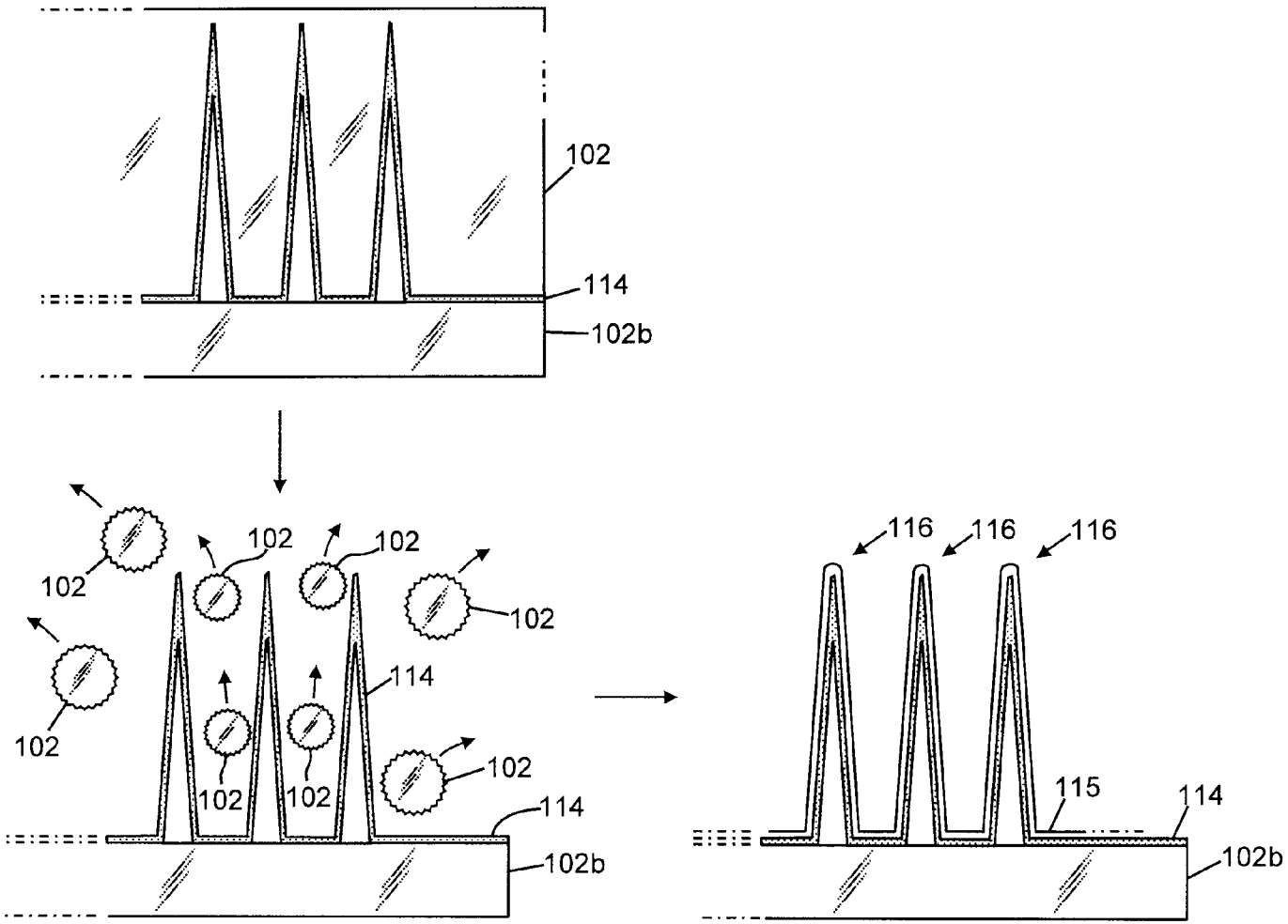
FIGS. 6A-6B schematically illustrate respective alternative additional steps in the fabrication of a micro-pillar array electrospray device in accordance with the present invention.
Figure 6B:
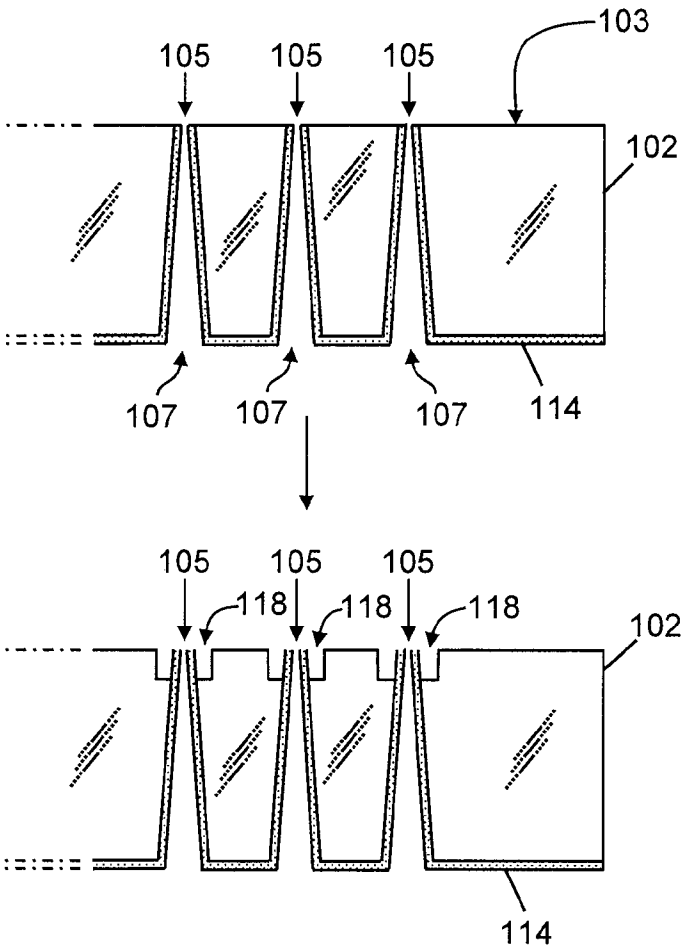

FIGS. 6A-6B schematically illustrate respective alternative subsequent steps in the fabrication of a micro-pillar array electrospray device in accordance with the present invention. In a first alternative procedure (FIG. 6A), a bottom substrate 102*b* is preferably bonded to or formed on the bottom side (that is, the side opposite to the tips of the pillars) of the multi-pillared electrode 114 in order to provide structural support to the multi-pillared electrode. Optionally, prior to mating to the substrate 102*b*, a filling material may be applied to the hollow pillar interiors to provide further structural support. The remaining bulk substrate material 102 is then removed by chemical dissolution or physical separation so as to expose the upper pillared side of the multi-pillared electrode 114.

Optionally, all or portions of the exposed side of the multi-pillared electrode may have a coating 115 deposited on it (them), the coating imparting further structural integrity or desirable surface properties to the multi-pillared electrode. For instance, the coating 115 may comprise a hydrophilic material which may have the function of increasing the tendency of an aqueous analyte-bearing liquid to spread along the surface of the coated multi-pillared electrode. Alternatively, the surface of the multi-pillared electrode 114 may receive a surface treatment, such as roughening of the surface on a nanometer scale, to increase the "wetting" tendencies of analyte-bearing liquids applied to the surface. New types of coatings are discussed by P. Forbes in an article titled "Self-Cleaning Materials" (Scientific American, August 2008, pp. 88-95. For instance, a thin-film coating of titania ($TiO_2$) that has been exposed to ultraviolet light may provide "superhydrophilic" properties to the electrode, enabling an analyte-bearing liquid to spread along the surface as a film along the coated portions of the electrode. Such coating could even be patterned so as to channel the liquid—that is, direct the liquid along pre-determined pathways—on the surface of the electrode. Further, coatings are known whose wettability properties are "switchable"—capable of being controllably and reversibly transformed between (super)hydrophilic and (super)hydrophobic states with the application of certain wavelengths of light. Such coatings applied to all or portions of the multi-pillared electrode 114 may act as valves (for instance, "shut-off" valves) for initiating, stopping or even controlling rate of liquid flow to the pillars of the electrode.

In a second alternative procedure (FIG. 6B), the bulk substrate material 102, together with the included multi-pillared electrode 114, is either cut, ground or polished so as to expose an ejection surface 103 which is disposed so as to remove the tips of the pillars, thereby truncating the pillar ends so as to expose a plurality of emission apertures 105 having aperture diameters of approximately 1 μm or less. Alternatively, the aperture diameters may be up to 15 μm. With the pillar tips removed in this fashion, the truncated hollow pillars of the multi-pillared electrode 114 may be used as capillaries or conduits, wherein analyte-bearing liquid flows from injection apertures 107 to emission apertures 105 so as to be emitted therefrom under electrospray emission conditions. The fabrication technique illustrated in FIG. 5B thereby provides a novel method for fabricating a nano-electrospray emitter array. The substrate 102 remains attached to the multi-pillared electrode 114 in such an emitter array so as to provide structural support to the pillars. Optionally, recessed regions 118 may be formed around the truncated ends of individual pillars (or, around groups or clusters of pillars) by micromachining techniques in order to prevent analyte-bearing liquid from spreading out from the emission apertures 105 onto the surface 103. Alternatively, the surface 103 may be coated with a coating (not shown), such as a hydrophobic coating, that has a tendency to not be "wet" by the analyte-bearing liquid. For instance, as described by P. Forbes (supra), the coating may comprise a superhydrophobic coating comprising a nanostructure that repels the liquid or may even comprise a switchable coating that could be used, for instance, as a diversion valve to drain excess liquid away from the pillar tips.

The individual pillars of the device resulting from the set of operations illustrated in FIG. 6A may be used electrospray emitters. Thus, the device may function as a multi-emitter nano-electrospray device. The tips of the pillars 116 of such device do not comprise apertures and thus, in operation, analyte-bearing liquid is not applied to the interiors of the pillars and is not caused to flow through the interiors of the pillars. Therefore, in contrast to conventional electrospray devices used in mass spectrometry, analyte-bearing liquids are caused to move to the emitting pillar tips by migration along exterior surfaces of the pillars. The analyte-bearing liquid is applied to the multi-pillared electrode at the bases of the pillars. Assuming that the liquid has sufficient tendency to "wet" the surface of the multi-pillared electrode 114, it may be caused to move towards the pillar tips by a combination of surface tension (i.e., "wicking") and electrostatic or hydrodynamic (or both) effects, the latter obtained when a voltage difference is applied between the multi-pillared electrode 114 and an extractor electrode. The apparatus does not require external pumping to supply the analyte-bearing liquid subsequent to its initial introduction into the apparatus; the wicking acts as a pump to replace the liquid volume that was sprayed from the tip.

An end product of the fabrication steps discussed above is the monolithic or continuous-surface multi-pillared electrode 114. In some embodiments, the multi-pillared electrode may comprises approximately 1000-10,000 emitting pillars or needles per $cm^2$ (inter-pillar spacing of emitting pillars of approximately 100-320 μm) with each emitting pillar having a height of approximately 10 μm to several tens of microns above an inter-pillar base portion of the electrode. Such an electrode could provide the benefits of nanospray ionization into flow regimes characteristic of typical liquid chromatography experiments. For example, in order to be compatible with mass spectrometer ion inlets, such an electrode may have a "footprint" area of about 1 $cm^2$ or less. If an electrode of 1 $cm^2$ footprint area comprises 1000 emitting pillars, each pillar capable of ionizing 100 nanoliters (nl) of solution per minute, then the combined action of all the pillars can ionize 0.1 ml/min of sample, which is within the realm of routine laboratory sample flow rates. Generally, the ionization rate per pillar will be the flow-limiting step. Each pillar will "drain", on average, an amount of liquid equivalent to approximately 1 μm depth per minute, which should be well within the replenishment capabilities of the liquid delivery conduits or channels.

Some embodiments may employ a smaller emitter electrode having a square area of approximately 1 $mm^2$, which may be suitable for interchange with conventional single-capillary electrospray devices. Assuming an inter-pillar spacing of emitting pillars of approximately 31-32 μm, then 1000 emitting pillars can be incorporated onto such an electrode, corresponding to a pillar density of 100,000 per $cm^2$. In this situation, the ability to distribute the liquid evenly among the pillars must be considered. If, once again, the liquid delivery rate is 0.1 ml/min and each pillar ionizes 100 nanoliters (nl) of liquid per minute, then each pillar is required to drain, on average, an amount of liquid equivalent to approximately 100 μm depth per minute. Even though this depth is generally greater than the pillar heights, it still may be possible to achieve such a flow rate with a steady state depth of approximately 1.5-2.0 μm that will not flood the electrode tips, provided that the fluid surge is prevented and that even fluid flow may be maintained in the inter-pillar regions of the electrode. A superhydrophobic coating or even perforations in the inter-pillar base portions of the electrode (to enable liquid delivery through the electrode from a substrate or reservoir on the opposite side) may be advantageously employed in this situation.

Figure 7:
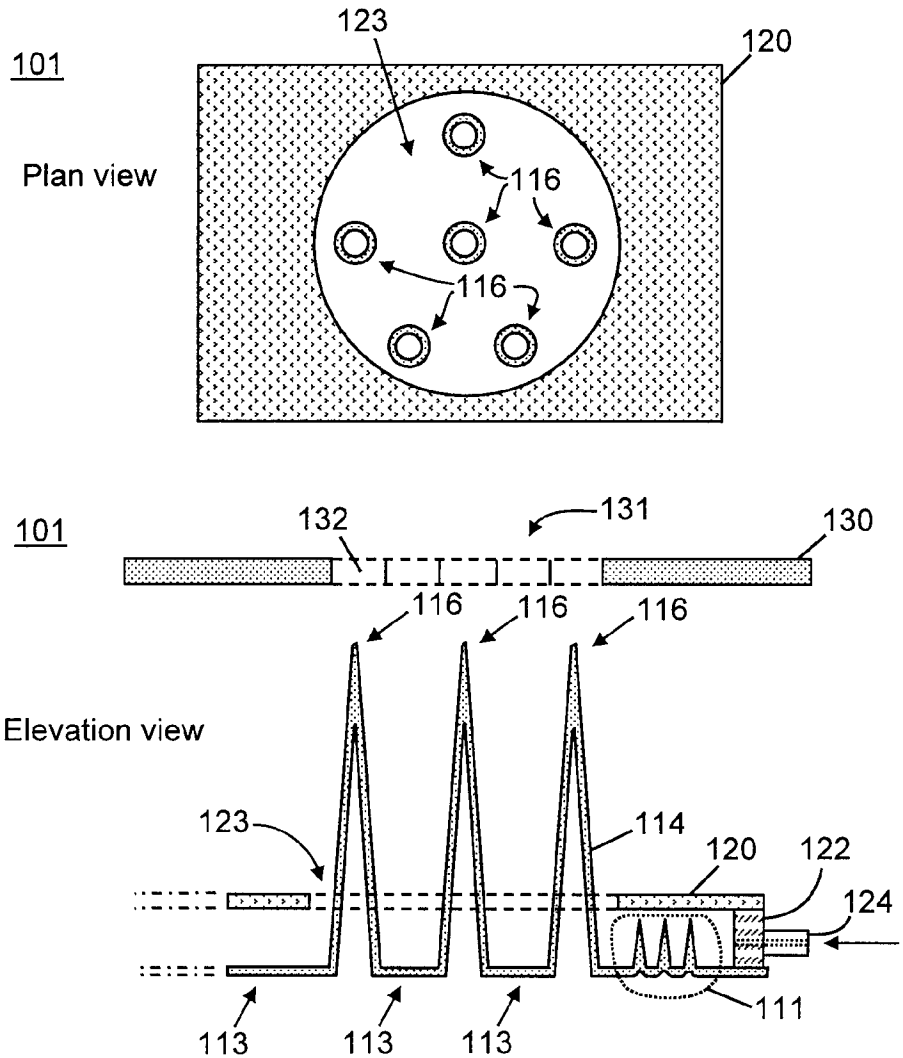
FIG. 7 illustrates one embodiment of a nano-electrospray apparatus in accordance with the present invention, in schematic plan and elevation views.

FIG. 7 illustrates one embodiment of an apparatus in accordance with the present invention, in schematic plan and elevation views. The apparatus 101 shown in FIG. 7 comprises a multi-pillared emitter electrode 114 and an extractor electrode 130, the extractor electrode 130 only shown in the elevation view of FIG. 7. The multi-pillared emitter electrode 114 comprises a plurality of pillars 116 integrated with a plurality of base portions or inter-pillar portions 113. The multi-pillared emitter electrode 114 comprises an electrically conductive surface to which an electric potential (low kilovolt range) is applied. The exteriors of the pillars and a side of the base facing the pillars may comprise a single continuous surface. The electric field is largest at the tips and the electromotive force there is large enough to overcome the surface tension such that small charged droplets will be emitted. Most of these droplets readily evaporate to produce ions (as well as, possibly, some residual droplets) that may be directed to a first vacuum stage of a mass spectrometer for analysis.

The extractor electrode 130 (also referred to as a counter electrode) comprises an aperture 131 through which charged particles emitted from a sample pass under the influence of an electrical potential applied between the multi-pillared emitter electrode 114 and the extractor electrode 130. The extractor electrode may comprise a portion of a mass spectrometer and, as such, the aperture 131 may comprise an ion inlet aperture of a mass spectrometer. The aperture 131 may be subdivided into a plurality of sub-apertures 132 separated by partitions or other structural elements. The apparatus 101 may, optionally, further comprise a cover plate 120 that is disposed substantially perpendicular to the longitudinal axes of the pillars 116 and that is maintained at a distance from the base portions or inter-pillar portions 113 of the multi-pillared emitter electrode 114 by means of one or more spacers 122. The size of the resulting gap between the base or interpillar portions 113 and the cover plate 120 could be controlled to regulate the flow of liquid and prevent it from spilling out. This gap can also serve as a buffer reservoir to guard against overfilling of the apparatus from an externally supplied liquid pumped into the apparatus at a rate that does not match the rate of wicking of liquid along the pillar surfaces.

One or more fluid inlet conduits 124 such as capillary tubes may pass through the one or more spacers 122 so as to introduce analyte-bearing sample liquids into the gap or gaps between the base or inter-pillar portions 113 of the multi-pillared emitter electrode 114 and the cover plate 120. The fluid inlet conduit or conduits 124 may serve, for instance, to couple the apparatus to a liquid chromatograph or a syringe pump so that eluent would flow into the gap and between the pillars 116 so as to be subsequently wicked towards the pillar tips. The emitter electrode 114 may be formed into a region of relatively short pillars 111 (for instance, see the upper right drawing of FIG. 5) in the space between the cover plate 120 and the base or interpillar portions 113 into which the analyte-bearing liquid is introduced. The cover plate 120 comprises one or more apertures 123 through which relatively taller pillars—used as ion emitters—pass. Advantageously, the relatively short pillars of the region 111 provide increased surface area which may assist the flow of analyte-bearing liquid from the one or more fluid inlet conduits 124 to the one or more apertures 123 of the cover plate 120.

Figure 8:
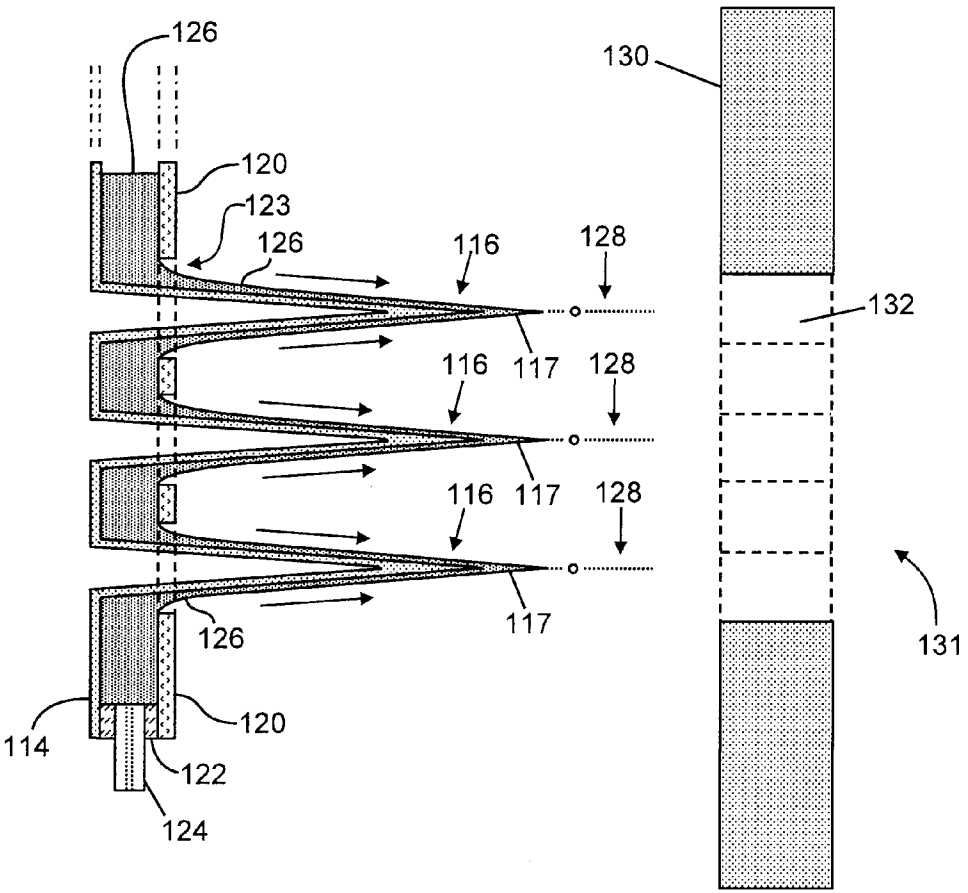
FIG. 8 illustrates operation of the apparatus of FIG. 7.

FIG. 8 illustrates a detailed view of the apparatus 101 in operation. As indicated by arrows in FIG. 8, analyte-bearing liquid 126 that flows into the vicinity of an aperture 123 of the cover plate 120 is further drawn or otherwise caused to move along the outer surfaces of pillars 116 passing through the aperture under the influence of surface tension or hydrodynamic effects or electrostatic effects (or some combination of these). Preferably, the upper surface of the cover plate 120 either comprises or is coated with a material whose surface properties are such that it is not readily "wet" by the analyte bearing liquid. For instance, if the analyte-bearing liquid comprises an aqueous solution, then it is desirable that the upper surface of the cover plate is hydrophobic so as to prevent spreading of the liquid on the cover plate. As described by P. Forbes (supra), the coating may comprise a superhydrophobic coating comprising a nanostructure that repels the liquid or may even comprise a switchable coating. The cover plate may not be required at all when the total quantity of analyte-bearing liquid is sufficiently small—in such a situation, the liquid may be retained on and will flow on the multi-pillared electrode solely by surface tension or electrostatic forces, or both.

Generation of an electric field in the vicinity of the emitter electrode 114 by application of a voltage difference between the multi-pillared emitter electrode and the extractor electrode 130 produced a concentration of electric field lines at each pillar tip. With sufficient electric field strength, the analyte-bearing liquid 126 deforms into a Taylor cone 117 at each respective pillar tip and emits a charged stream 128, comprising a jet, a spray of charged liquid droplets and, ultimately, a cloud of free ions. The emitter plate is set to be the anode if positively charged ions are to be emitted and is set to be the cathode if negatively charged ions are to be emitted. The liberated ions are then electrostatically directed into an ion inlet orifice of a mass spectrometer for analysis. The extractor electrode may, in fact, comprise an ion inlet orifice plate of the mass spectrometer. In order to minimize space charge effects, the pillar tips may be located at a distance from a mass spectrometer ion inlet port such that the ion flow has been accelerated towards the ion inlet port up to a velocity greater than a certain threshold velocity—for instance, greater than about 10-50 m/s.

Figure 9:
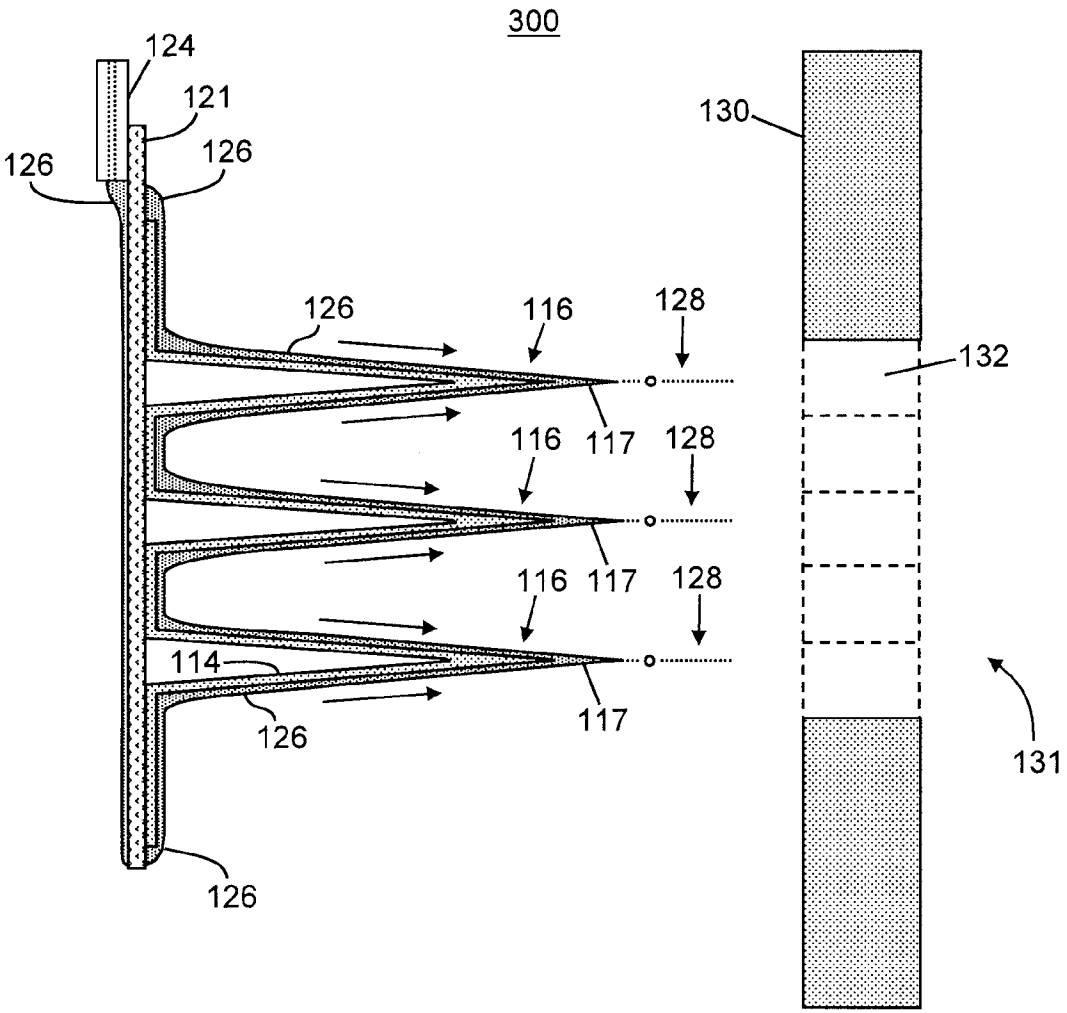
FIG. 9 illustrates operation of an alternative embodiment of a nano-electrospray apparatus in accordance with the present invention.

FIG. 9 illustrates operation of an alternative embodiment of an apparatus in accordance with the present invention. In the system 300 shown in FIG. 9, analyte-bearing liquid 126 is introduced by absorption and wicking through a porous permeable substrate or reservoir 121 facing the "back" side of the emitter electrode—that is, the opposite side of the emitter electrode 114 from the tips of the pillars 116. The substrate 121 may be made, for instance, from a fibrous material, filter paper or nucleopore material, possibly laminated or adhered onto another layer or substrate that provides structural integrity. One or more fluid inlet conduits 124 may introduce the analyte-bearing liquid into or onto the side of the permeable substrate opposite to the electrode 114. Capillary action causes the liquid to spread throughout the porous substrate and to penetrate to the opposite side of the substrate where it may flow onto exposed edges of the emitter electrode 114. The surface of the multi-pillared electrode 114 may comprise a surface coating or treatment to increase the "wetting" tendency of the analyte-bearing liquid with the surface, thereby drawing the liquid onto the surface from the substrate 121. Alternatively or in addition, the base portions of the emitter electrode 114 may be perforated (by laser ablation, microdrilling, patterned etching or patterned deposition of the electrode during the fabrication process) so as to permit the liquid to flow through the electrode from the back side to the front side. Accordingly, the cover plate 120 as shown in FIG. 8 may not be required in the system 300 (FIG. 9).

Figure 10:
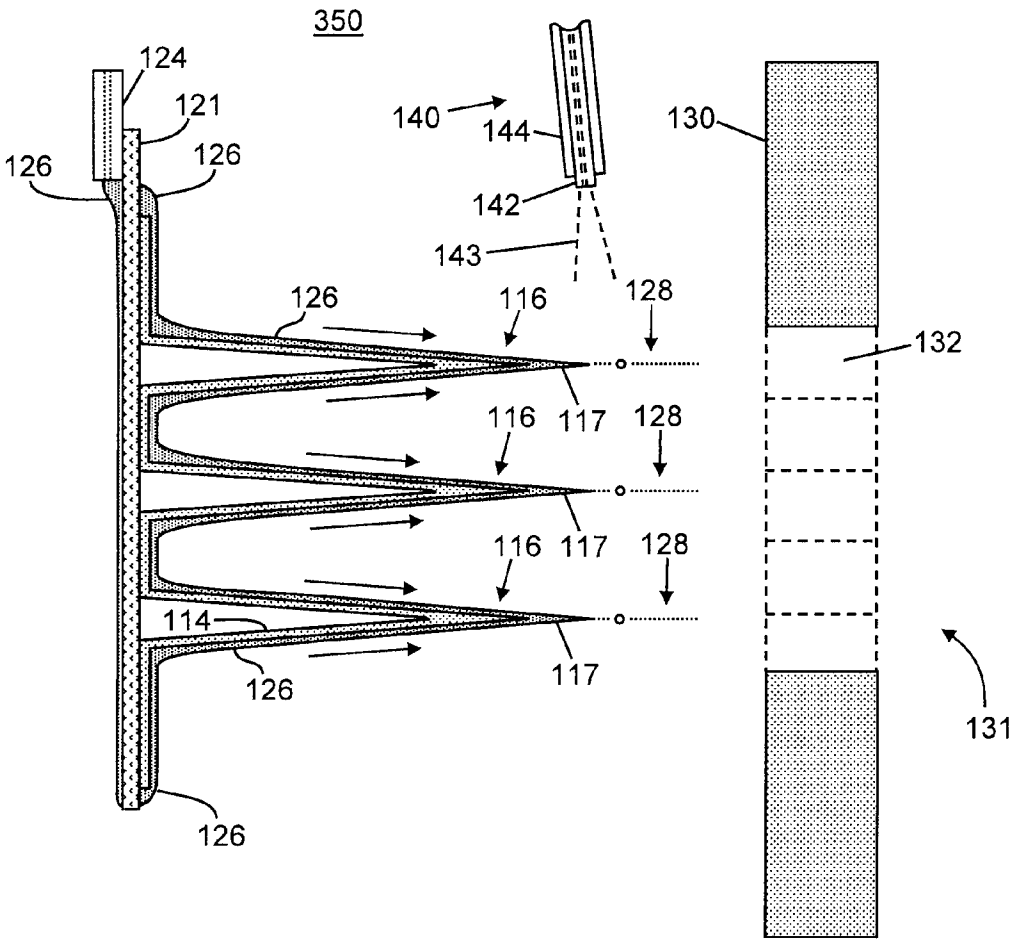
FIG. 10 illustrates operation of an alternative embodiment of a nano-electrospray apparatus in accordance with the present invention.

FIG. 10 illustrates operation of an alternative embodiment of an apparatus in accordance with the present invention. The system 350 shown in FIG. 10 is a variation of the system 300 (FIG. 9) which employs auxiliary side electrospray apparatus 140, similar to one described by Hiraoka et al., disposed so as to produce an electrospray 143 of solvent liquid directed towards the emitting pillars 116 so as to maintain a vapor pressure of solvent, in the vicinity of the pillars, that is sufficiently great so as to prevent evaporation of the analyte-bearing liquid 126 adhered to the pillars. The solvent electrospray emitted by the auxiliary side electrospray apparatus 140 should preferably be the same solvent as is used in the analyte-bearing liquid 126. The auxiliary electrospray apparatus may include a capillary 142 supplied with the solvent, and an external tube 144 enclosing the capillary 142 with such that a nebulizing sheath gas may flow between the capillary 142 and the external tube 144. The auxiliary side electrospray apparatus 140 may operate with assist from the sheath or nebulizing gas according to conventional methods.

Figure 11:
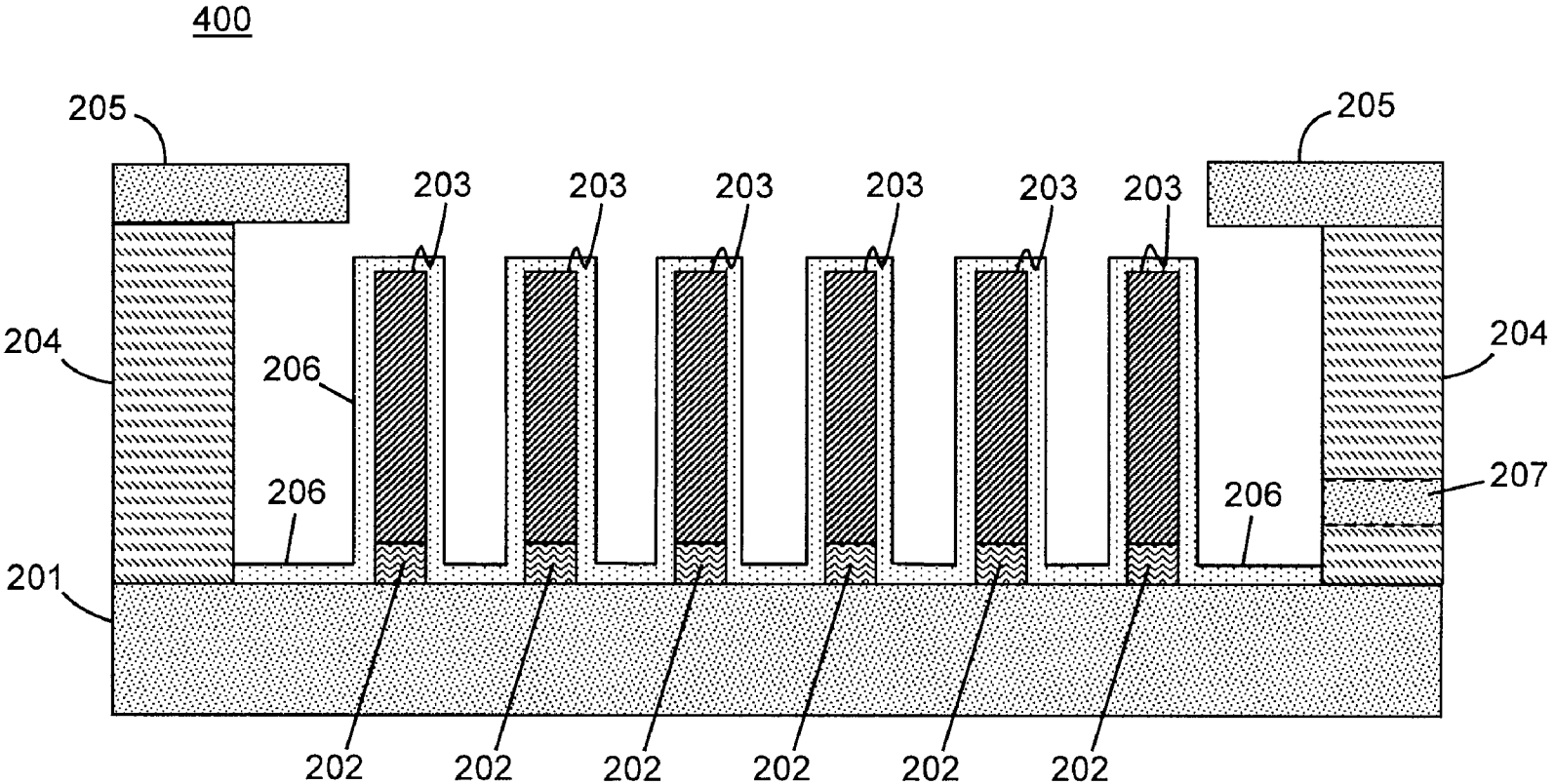
FIG. 11 illustrates an alternative nano-electrospray apparatus in accordance with the invention.

FIG. 11 illustrates an alternative nano-electrospray apparatus in accordance with the invention. The apparatus 400 schematically illustrated in FIG. 11 comprises a plurality of columns 203 comprised of carbon nanotube (CNT) material. Each column comprises a bundle of CNT nanotubes produced by chemical vapor deposition onto a respective dot of a catalyst material, such as iron. The advantage of employing such a CNT column array is that the pattern and spacing of catalyst dots (on which the CNT columns are subsequently grown) may be controlled on a scale of less than 100 nm by depositing the catalyst dots on a substrate using the technique of electron beam lithography together with a photoresist layer. The fabrication of CNT column arrays for use as electron emitters has recently been described (Manohara et al., "Arrays of Bundles of Carbon Nanotubes as Field Emitters", NASA Tech Briefs, 31(2), 2007, p. 58; Toda et al., "Fabrication of Gate-Electrode Integrated Carbon-Nanotube Bundle Field Emitters", NASA Tech Briefs, 32(4), 2008, p. 50; Toda et al., "Improved Photoresist Coating for Making CNT Field Emitters", NASA Tech Briefs, 33(2), 2009, pp. 38-40). In those publications, the CNT column arrays are described as deposited in a recess fabricated in a commercially available double silicon-on-insulator wafer. The recess, including with a partially overhanging gate electrode, is formed by a combination of wet etching, deep reactive-ion etching and isotropic silicon etching by xenon difluoride. Presently, there appears to have been no appreciation of using CNT column arrays as electrospray ion emission devices.

Still referring to FIG. 11, the CNT columns 203 are formed on catalyst dots 202 deposited on a suitable substrate 201, such as a silicon wafer, the face 209 of the substrate upon which such dots are deposited comprising a "floor" for the CNT columns 203. A optional coating 206, such as a thin film coating deposited by chemical vapor deposition, may be deposited on or applied to the substrate floor 209 and the surfaces of the CNT columns 203 so as to provide surfaces that are "wettable" by potential analyte-bearing liquids. An overhanging extractor electrode 205 is spaced away from the substrate 201 on the same side of the substrate as the CNT columns 203 by one or more sidewalls or spacers 204 such that an imaginary extension of a plane of the extractor electrode does not intersect the CNT columns. At least one fluid inlet 207 in either the substrate 201 or a sidewall 204 is fluidically connected to a source of analyte-bearing liquid and is used to introduce such analyte-bearing liquid to the bases of the columns and the region of the floor 209 (possibly coated) surrounding the columns.

In operation, the nano-electrospray apparatus 400 is utilized to introduce electrosprayed ions into the ion inlet orifice of a mass spectrometer similar to the situation illustrated in FIG. 8 and previously discussed with regard to the multi-pillared electrode device 101. The overhanging extractor electrode 205 may be eliminated if the nano-electrospray apparatus 400 is sufficiently close to the mass spectrometer ion inlet orifice such that the orifice plate may itself be used as the electrode. In such a situation, the sidewalls or spacers may also be eliminated.

Figure 12:
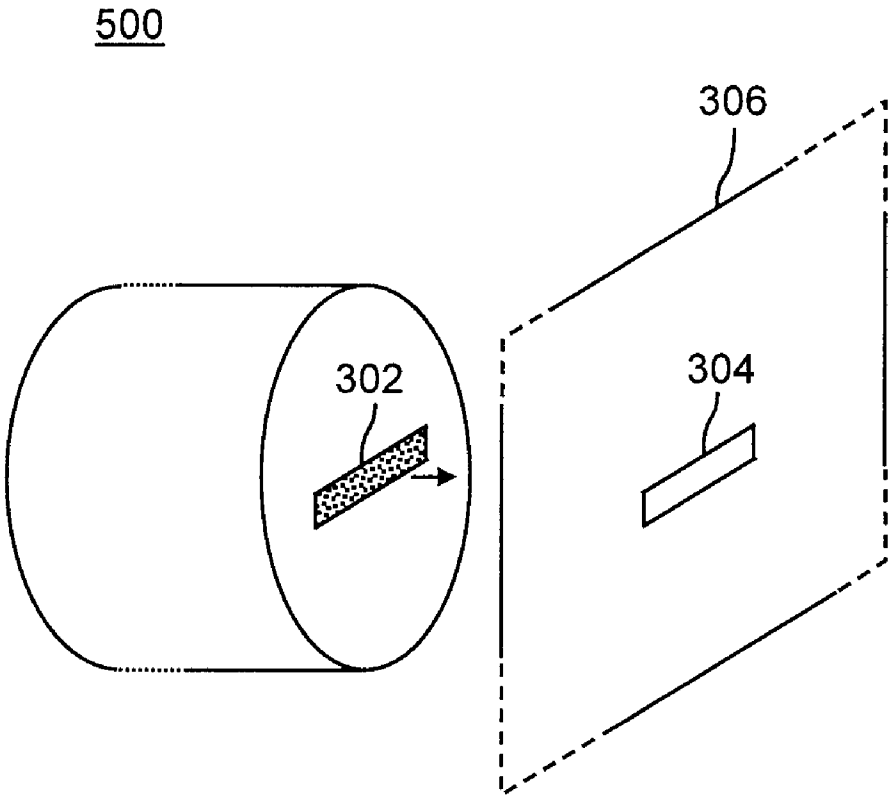
FIG. 12 schematically illustrates a nano-electrospray apparatus and spectrometer inlet system in accordance with the invention.

FIG. 12 schematically illustrates a nano-electrospray apparatus and spectrometer inlet system 500 in accordance with the present teachings. The nano-electrospray multi-emitter array 302 comprises a plurality of protrusions such as needles, cones, rods, pillars, columns or wires, each of which emits charged particles, such as analyte ions, in the general direction of a mass spectrometer housing 306 having an ion inlet aperture 304. The ion inlet aperture 304 may comprise an aperture of a skimmer structure or portion of a skimmer structure or, alternatively, may comprise an inner bore (not necessarily circular in cross section) of a heated ion inlet tube. The nano-electrospray multi-emitter array 302 may be fabricated according to the methods previously discussed in this document, but generally may comprise any suitable plurality of needles, cones, rods, pillars or columns fabricated by any means.

The nano-electrospray multi-emitter array 302 shown in FIG. 12 may formed in a particular shape chosen to most efficiently match the dimensions or shape of the droplet mists or ion plumes that are emitted from the various emitters. For instance, the overall shape of the array could comprise an elongated or letter box shape as shown in FIG. 12 or could comprise a circular shape or any other shape. The fabrication techniques discussed earlier in this document enable the array to be formed in any desired shape. For instance, masking techniques could be used at either the heavy ion exposure stage or the latent ion track etching stage of the processes described previously in order to create a pillared region of a desired size or shape. Alternatively, the pillared material could be created in bulk and a portion of the bulk material subsequently cut or sliced into a desired size or shape (such as a linear strip, or an ellipse or circle) so as to form the nano-electrospray multi-emitter array 302. In order to efficiently capture the ions generated by the nano-electrospray multi-emitter array 302, the mass spectrometer ion inlet aperture 304 may be constructed a shape which matches or corresponds to that of the array, as shown in FIG. 12.

The discussion included in this application is intended to serve as a basic description. Although the present invention has been described in accordance with the various embodiments shown and described, one of ordinary skill in the art will readily recognize that there could be variations to the embodiments and those variations would be within the spirit and scope of the present invention. The reader should be aware that the specific discussion may not explicitly describe all embodiments possible; many alternatives are implicit. Accordingly, many modifications may be made by one of ordinary skill in the art without departing from the spirit, scope and essence of the invention. Neither the description nor the terminology is intended to limit the scope of the invention. Any publications, patents or patent application publications mentioned in this specification are explicitly incorporated by reference in their respective entirety.

What is claimed is:

1. An electrospray ion source for a mass spectrometer comprising:

an electrode comprising at least a first plurality of protrusions protruding from a base, each protrusion of the at least a first plurality of protrusions having a respective tip;

a conduit for delivering an analyte-bearing liquid to the electrode; and a voltage source, wherein, in operation of the electrospray ion source, the analyte-bearing liquid is caused to move, in the presence of a gas or air at a pressure within the range of 0.03× to 2×atmospheric pressure, from the base to each protrusion tip along a respective protrusion exterior so as to form a respective stream of charged particles emitted towards an ion inlet aperture of the mass spectrometer under application of voltage applied to the electrode from the voltage source.

2. An electrospray ion source as recited in claim 1, wherein an average spacing between adjacent protrusions is less than 350 μm.

3. An electrospray ion source as recited in claim 1, wherein an average spacing between adjacent protrusions is less than or equal to 100 μm.

4. An electrospray ion source as recited in claim 1, wherein an average tip width is less than 5 μm.

5. An electrospray ion source as recited in claim 1, wherein the protrusions comprise a metal.

6. An electrospray ion source as recited in claim 5, wherein the plurality of protrusion exteriors comprise one continuous surface.

7. An electrospray ion source as recited in claim 1, wherein the protrusions comprise bundles of carbon nanotubes.

8. An electrospray ion source as recited in claim 1, further comprising a coating layer adhered to at least a portion of each of the protrusions, the coating layer providing an increase in a tendency of the analyte-bearing liquid to be drawn towards the protrusion tips.

9. An electrospray ion source as recited in claim 8, wherein the coating layer comprises a superhydrophylic material.

10. An electrospray ion source as recited in claim 8, wherein the coating layer comprises titania ($TiO_2$).

11. An electrospray ion source as recited in claim 8, wherein the coating layer comprises a material that can be switched so as to have either hydrophobic or hydrophilic properties.

12. An electrospray ion source as recited in claim 1, further comprising an extractor electrode spaced at a distance from the electrode so as to form a gap therebetween, the extractor electrode having an aperture therein such that, in operation of the electrospray ion source, an electric field between the electrode and the extractor electrode causes a portion of the emitted charged particles to be propelled through the aperture in the extractor electrode.

13. An electrospray ion source as recited in claim 12, wherein the aperture in the extractor electrode and the ion inlet aperture are the same aperture.

14. An electrospray ion source as recited in claim 1, further comprising:

a cover plate having at least one aperture therein; and a spacer disposed between the cover plate and the base of the electrode, so as to form a gap between at least a portion of the cover plate and at least a portion of the electrode, such that analyte-bearing liquid delivered from the conduit is caused to flow into the gap, wherein the first plurality of protrusions protrude through the at least one aperture.

15. An electrospray ion source as recited in claim 14, further comprising a coating layer adhered to at least a portion of the cover plate, the coating layer providing a decrease in a tendency of the analyte-bearing liquid to spread on the cover plate.

16. An electrospray ion source as recited in claim 15, wherein the coating layer comprises a superhydrophobic material.

17. An electrospray ion source as recited in claim 15, wherein the coating layer comprises a material that can be switched so as to have either hydrophobic or hydrophilic properties.

18. An electrospray ion source as recited in claim 1, further comprising a bottom substrate adhered to or in contact with a side of the electrode opposite to the protrusions.

19. An electrospray ion source as recited in claim 18, wherein the substrate comprises a permeable reservoir configured for receiving the analyte-bearing liquid from the conduit and delivering the analyte-bearing liquid to the electrode base.

20. An electrospray ion source as recited in claim 1, wherein the first plurality of protrusions occupy an area of the electrode having a shape and wherein the ion inlet aperture comprises a shape that corresponds to the shape of the area of the electrode occupied by the first plurality of protrusions.

21. An electrospray ion source as recited in claim 20, wherein the shape of the area occupied by the first plurality of protrusions and the shape of the ion inlet aperture are both circles.

22. An electrospray ion source as recited in claim 20, wherein the shape of the area occupied by the first plurality of protrusions and the shape of the ion inlet aperture are both rectangles.

23. An electrospray ion source as recited in claim 1, wherein the protrusion tips are located at a distance from the ion inlet aperture such that the stream of charged particles attains a velocity greater than or equal to a certain threshold velocity.

24. An electrospray ion source as recited in claim 23, wherein the threshold velocity is 10 m/s.

25. An electrospray ion source as recited in claim 23, wherein the threshold velocity is 50 m/s.

26. A method of fabricating a multi-emitter electrospray electrode comprising the steps of:

(a) providing a substrate;

(b) exposing a first side of the substrate to a beam of accelerated heavy ions so as to produce a set of latent ion tracks within the substrate that do not penetrate to an opposite side of the substrate;

(c) exposing the first side of the substrate to a chemical etchant so as to form a plurality of etch channels within the substrate that extend into the substrate interior from the first side and that do not penetrate to the opposite side of the substrate;

(d) depositing a layer of conductive material within the etch channels and on the first side of the substrate; and (e) removing the substrate from the conductive material, the conductive material comprising the multi-emitter electrospray electrode.

27. A method as recited in claim 26, further comprising:

(f) depositing a coating layer on a side of the conductive material exposed by the removal of the substrate, the coating layer providing a surface on which an analyte-bearing liquid has a tendency to spread.

28. A method of fabricating a multi-emitter electrospray electrode comprising the steps of:

(a) providing a substrate;

(b) exposing a first side of the substrate to a beam of accelerated heavy ions so as to produce a set of latent ion tracks within the substrate that do not penetrate to an opposite side of the substrate;

(c) exposing the first side of the substrate to a chemical etchant so as to form a plurality of etch channels within the substrate that extend into the substrate interior from the first side and that do not penetrate to the opposite side of the substrate;

(d) depositing a layer of conductive material within the etch channels and on the first side of the substrate, the conductive material deposited within the etch channels comprising a plurality of conical pillars having tips; and (e) removing a portion of the opposite side of the substrate and at least a portion of the tips of the conical pillars so as to truncate a subset of the plurality of conical pillars, the truncated conical pillars comprising hollow electrospray nozzles of the multi-emitter electrospray electrode.

29. A method for providing ions derived from an analyte-bearing liquid to a mass spectrometer by electrospray ionization, the analyte-bearing liquid supplied at a total flow rate of greater than or equal to 50 microliters (μl) per minute comprising:

(a) dividing the total flow into a plurality of sub-flows of analyte-bearing liquid, each sub flow providing a portion of the total flow at a rate of less than or equal to 500 nanoliters (nl) per minute;

(b) providing a plurality of electrospray emitters;

(c) providing each sub-flow of analyte bearing liquid to a respective one of the electrospray emitters;

(d) generating an electrospray emission from each of the electrospray emitters; and (e) directing each electrospray emission to an ion inlet of the mass spectrometer.

30. A method as recited in claim 29, wherein the total flow rate is greater than or equal to 100 μl per minute.

31. A method as recited in claim 29, wherein the total flow rate is greater than or equal to 500 μl per minute.

32. A method as recited in claim 29, wherein each sub-flow rate is less than or equal to 200 nl per minute.

33. A method as recited in claim 29, wherein each sub-flow rate is less than or equal to 100 nl per minute.

34. A method as recited in claim 29, wherein the step (b) of providing a plurality of electrospray emitters comprises:

providing an electrode having a plurality of protrusions protruding from a base, each protrusion of first plurality of protrusions comprising a respective one of the electrospray emitters.

35. A method as recited in claim 34, wherein the step (a) of dividing the total flow into a plurality of sub-flows of analyte-bearing liquid comprises:

delivering the total flow of analyte-bearing liquid to the electrode base; and causing the analyte-bearing liquid to move from the base along an exterior of each respective protrusion to a tip of each respective protrusion.

* * * * *